US007803030B2

(12) United States Patent
Nagaoka

(10) Patent No.: US 7,803,030 B2
(45) Date of Patent: Sep. 28, 2010

(54) TOY VEHICLE, TOY ASSEMBLY DEVICE AND METHOD FOR ASSEMBLING TOY

(75) Inventor: Junichi Nagaoka, Tokyo (JP)

(73) Assignees: Tomy Company, Ltd., Tokyo (JP); Tokyo Unique Co., Ltd., Tokyo (JP)

( * ) Notice: Subject to any disclaimer, the term of this patent is extended or adjusted under 35 U.S.C. 154(b) by 376 days.

(21) Appl. No.: 11/905,325

(22) Filed: Sep. 28, 2007

(65) Prior Publication Data

US 2008/0171486 A1 Jul. 17, 2008

(30) Foreign Application Priority Data

Jan. 17, 2007 (JP) ..... 2007-8390

(51) Int. Cl.

*A63H 33/00* (2006.01)
*A63H 17/00* (2006.01)
*A63H 33/04* (2006.01)
*A63H 17/26* (2006.01)

(52) U.S. Cl. ..... 446/93; 446/69; 446/117; 446/470

(58) Field of Classification Search ..... 446/69, 446/79, 86, 93–96, 117, 465, 469–471; 206/335, 206/577; 273/156

See application file for complete search history.

(56) References Cited

U.S. PATENT DOCUMENTS 3,232,420 A * 2/1966 Haenle, Jr. ..... 206/575
3,611,618 A * 10/1971 Steiner ..... 446/95
4,349,984 A 9/1982 Goldfarb et al.
4,470,219 A * 9/1984 Sugimoto ..... 446/464
4,684,355 A * 8/1987 Urakawa et al. ..... 446/464
4,919,639 A * 4/1990 Hesse ..... 446/462
4,940,442 A * 7/1990 Matsuda ..... 446/90
4,986,789 A * 1/1991 Hang ..... 446/93
5,816,888 A * 10/1998 Myers ..... 446/456

FOREIGN PATENT DOCUMENTS

GB 2 358 360 7/2001
JP 3037901 * 3/1997

OTHER PUBLICATIONS

United Kingdom Search Report dated Jan. 11, 2008 issued in corresponding UK Application No. 0717780.1.

* cited by examiner

*Primary Examiner*—Gene Kim
*Assistant Examiner*—Alyssa M Hylinski
(74) *Attorney, Agent, or Firm*—Staas & Halsey LLP

(57) ABSTRACT

A toy vehicle, a toy assembly device and a related method includes a toy body having a plurality of component members, and a plurality of support frame members respectively supporting the component members. The component members and the support frame members have respective engaging portions that can engage and disengage in a horizontal direction. Each of the support frame members has a fitting part provided thereon for connecting the support frame members to one another. Each of the component members has a fitting portion provided thereon for connecting the components members to one another. When the support frame members, each with a component member supported thereon, are connected to one another through the fitting parts, the component members are connected to one another by the fitting portions to form the toy body, so that the toy body can engage with or disengage from the support frame members connected to one another.

15 Claims, 9 Drawing Sheets

TOY VEHICLE, TOY ASSEMBLY DEVICE AND METHOD FOR ASSEMBLING TOY

BACKGROUND OF THE INVENTION

1. Field of the Invention

The present invention relates generally to a toy vehicle, a toy assembly device and method for assembling a toy, and, more particularly, to frame members, with component members making up a toy body mounted thereto, being placed one on top of the other, the component members being connected to one another to form the toy body and the toy body thus formed can be separated from the frame members.

2. Description of the Related Art

Conventionally, a toy vehicle in which driving performance can be improved by connecting a front chassis section and a rear chassis section of a divided chassis in different combinations, and a body can be assembled on the thus formed chassis, has been proposed in, for example, Japanese Registered Utility Model No. 3037901. In this toy vehicle, the chassis is divided into the front chassis section and the rear chassis section. The front chassis section has fitting projections formed at its front bottom surface and mounting shafts formed at its front top surface for mounting the body, and has fitting holes formed at its rear. By fitting protrusions formed at the rear chassis section into the respective fitting holes of the front chassis section, the front chassis section and the rear chassis section can be connected to each other.

While the above toy vehicle is capable of being modified to a driving toy full of originality by connecting the front and rear chassis sections of the divided chassis and mounting a body to the thus connected chassis, it is possible that children would find it difficult to handle the toy vehicle due to various problems including the order and method of connecting members being difficult to understand from the disordered state of the members, and the divided chassis and body being stored in a disordered disassembled state are difficult to keep track of.

SUMMARY OF THE INVENTION

The present invention has been made to address at least the above problems. Accordingly, it is an object of the present invention to provide a toy whose component members, if mounted on respective support frame members, can be connected to one another by a simple operation of connecting the support frame members, allowing even children to enjoy assembly and disassembly of the toy body and allowing ease of storage.

In accordance with the present invention, a toy vehicle, a toy assembly device and a related method are provided. The toy assembly device includes: a toy body including a plurality of component members; and a plurality of support frame members for supporting the respective component members, wherein each of the component members and a corresponding one of the support frame members are provided thereon with respective engaging portions, the engaging portions being formed in such a manner that the engaging portion of said each of the component members and the engaging portion of said corresponding one of the support frame members can engage with or disengage from each other in a horizontal direction; the support frame members have fitting parts provided thereon and the support frame members are formed in such a manner that the support frame members can be connected or disconnected in a vertical direction by the fitting parts; the component members have fitting portions provided thereon and the component members are formed in such a manner that the component members can be connected to one another or disconnected from one another in the vertical direction through the fitting portions; when the support frame members are connected to one another through the fitting parts while the component members are supported by the respective support frame members, the component members are connected with one another by the fitting portions to form the toy body in an assembled state; the assembled toy body can be engaged with or disengaged from, in the horizontal direction, the support frame members connected to one another; and when the connection of the support frame members is released while the toy body is supported by the support frame members, the toy body is disassembled into the component members that are separately supported by the respective support frame members.

In one embodiment of the present invention, the toy body is a toy vehicle and the component members are a front wheel chassis, a rear wheel chassis, and a vehicle body; the front wheel chassis and the rear wheel chassis are each provided thereon with a respective one of the fitting portions, to thereby connect the front wheel chassis and the rear wheel chassis with each other; and the vehicle body is provided with two of the fitting portions and the front wheel chassis and the rear wheel chassis are each provided with a respective one of the fitting portions, whereby the vehicle body is connected with the front wheel chassis and the rear wheel chassis.

In another embodiment of the present invention, each of the support frame members has indicia providing information on a corresponding one of the component members to be supported thereon.

An aspect of the invention enables the component members to be automatically connected to form the toy body in an assembled state and the toy body to be separated from the connected support frame members by having the support frame members support the component members and connecting the support frame members supporting the component members, and enables the toy body to be disassembled into the component members supported by the support frame members by mounting the toy body on the connected support frame members and separating the support frame members from one another, and therefore enables the providing of a much-improved toy assembly device whose component members can be connected or disconnected automatically, thus allowing even children to easily assemble or disassemble the toy body.

Another aspect of the invention enables forming a toy vehicle having a front wheel chassis, a rear wheel chassis and a vehicle body.

A further aspect of the invention enables combining the component members by seeing the information on the component members indicated on the support frame members supporting the component members, and enables forming a toy body having originality by combining the component members according to a user's taste.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE EMBODIMENTS

Figure 1:
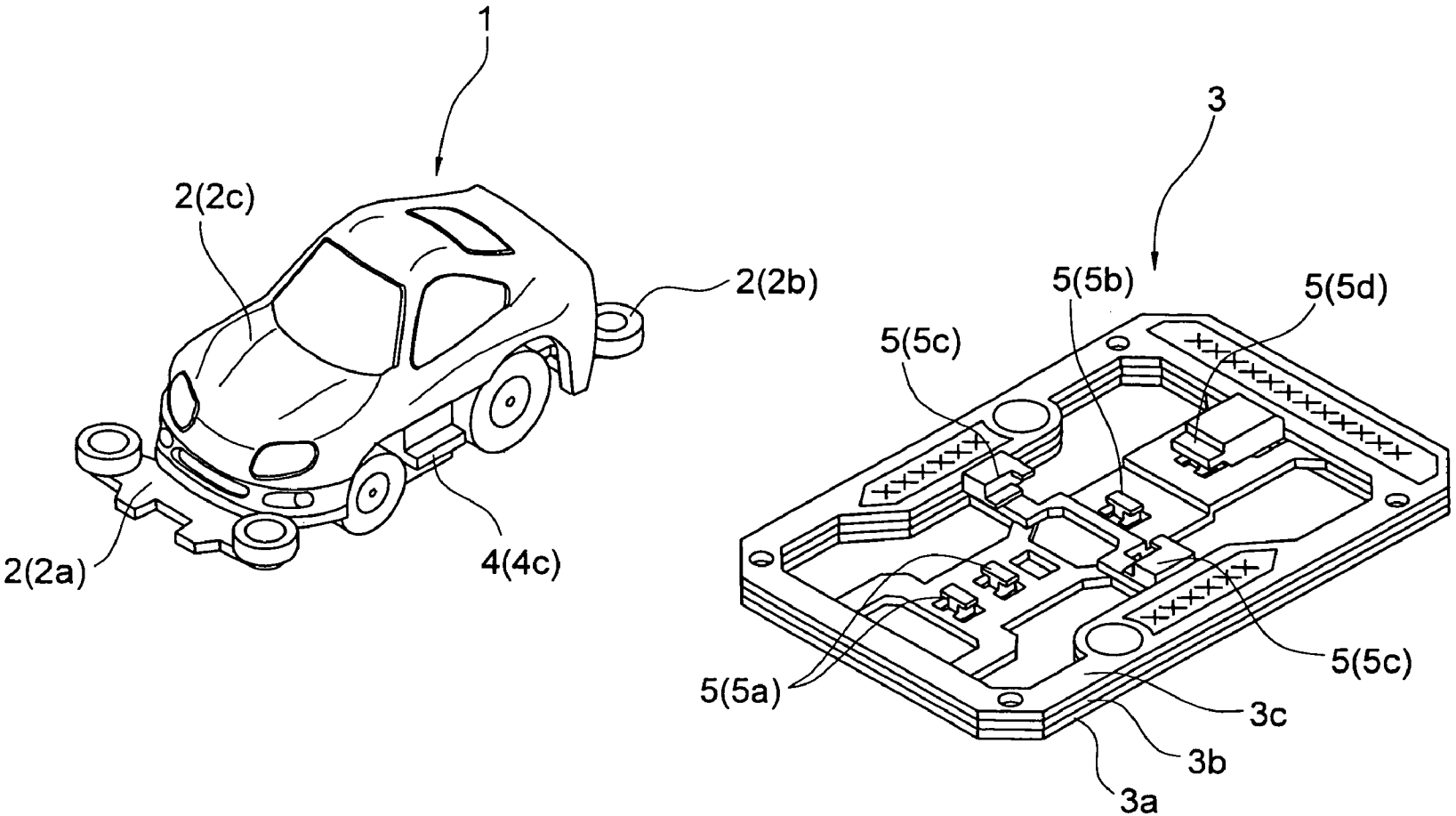
FIG. 1 is a perspective view of a toy body and a set of support frame members making up the toy assembly device according to one embodiment of the present invention.

FIG. 1 depicts an embodiment of the present invention. The toy vehicle and toy assembly device shown therein include a toy body 1 formed by connecting a plurality of component members 2 and a set of support frame members 3 supporting the component members 2. The toy body 1 may include three component members, namely a front wheel chassis 2*a*, a rear wheel chassis 2*b*, and a vehicle body 2*c* to form a running toy or toy vehicle.

The set of support frame members 3 preferably includes three support frame members, namely a lower frame member 3*a* for supporting the front wheel chassis 2*a*, a middle frame member 3*b* for supporting the rear wheel chassis 2*b*, and an upper frame member 3*c* for supporting the vehicle body 2*c*. The component members 2 each include an engaging portion 4 and the support frame members 3 each include a corresponding engaging portion 5 so that the engaging portions 4 of the component members 2 and the corresponding engaging portions 5 of the support frame members 3 are engaged with and disengaged from each other, respectively. The engagement between the engaging portions 4 and 5 and disengagement therefrom can be made by sliding the component member 2 in a horizontal direction relative to the support frame member 3.

The support frame members 3 are each provided thereon with a fitting part 6 for connecting one support frame member with another support frame member or members. The component members 2 are each provided thereon with a fitting portion 7 (see, e.g., FIG. 5A) for connecting one component member with another component member or members. The fitting parts 6 and the fitting portions 7 are so formed that when the support frame members 3 are stacked in a vertical direction while the component members 2 are engaged with the respective support frame members 3, the support frame members 3 are connected with one another by way of the fitting parts 6, and at the same time the component members 2 are connected with one another by way of the fitting portions 7 and the connected component members 2 form the toy body 1. The fitting parts 6 of the support frame members 3 and the fitting portions 7 of the component members 4 will be described later in more detail.

The lower frame member 3*a* includes a rectangular frame plate with an opening at its center and has a fitting part 6 constituted by fitting recesses 6*a* formed at its four corners on the top surface thereof for connecting it with the middle frame member 3*b*. The lower frame member 3*a* has arms 10 and 11 extending from its both sides and its front to support a holding plate 12 for holding the front wheel chassis 2*a*. An engaging portion 5 including two engagement elements 5*a* that protrude in a T-shape is formed on the top surface of the holding plate 12 to engage with an engaging portion 4 of the front wheel chassis 2*a*.

The lower frame member 3*a* has a plurality of stickers or other indicia 13*a* attached on the upper surface thereof providing information such as a configuration and specifications of the front wheel chassis 2*a* to be supported on the lower frame member 3*a*. The information printed on these stickers 13*a* is the information such as "front parts & tire", "long-distance race compatible" and "curve course performance up".

The middle frame member 3*b* includes a rectangular frame plate with an opening at its center and has a fitting part 6 which includes fitting projections 6*b* formed at its four corners on the bottom surface thereof and fitting recesses 6*c* formed at its four corners on the top surface thereof. The fitting projections 6*b* formed on the bottom surface of the middle frame member 3*b* are adapted to fit into the respective fitting recesses 6*a* of the lower frame member 3*a* and the fitting recesses 6*c* formed on the top surface of the middle frame member 3 are arranged for connecting the middle frame member 3*b* with the upper frame member 3*c*. The middle frame member 3*b* has arms 15 and 16 extending from its both sides and its rear to support a holding plate 17 for holding the rear wheel chassis 2*b*. An engaging portion 5 including two engagement elements 5*b* that protrude in a T-shape is formed on the top surface of the holding plate 17 to engage with an engaging portion 4 of the rear wheel chassis 2*b*.

The middle frame member 3*b* has a plurality of stickers 13*b* attached on the upper surface thereof providing information such as a configuration and specifications of the rear wheel chassis 2*b* to be supported thereon. The information printed on these stickers 13 is the information such as "rear parts & engine", "long-distance race compatible" and "speed type engine".

The upper frame member 3*c* includes a rectangular frame plate with an opening at its center and has a fitting part 6 which includes fitting projections 6*d* formed at its four corners on the bottom surface so as to fit into the respective fitting recesses 6*c* of the middle frame member 3*b*. The upper frame member 3*c* includes an engaging portion 5 constituted of engaging elements 5*c* and 5*d* formed so as to protrude toward the inside from its both sides and its rear for engaging with an engaging portion 4 of the vehicle body 2*c*.

The upper frame member 3*c* has a plurality of stickers 13*c* attached on the surface thereof providing information such as a configuration and specifications of the vehicle body 2*c* to be supported thereon. The information printed on these stickers 13*c* is the information such as "cowl", "middle-distance race type" and "excellent in air resistance".

Figure 3A:
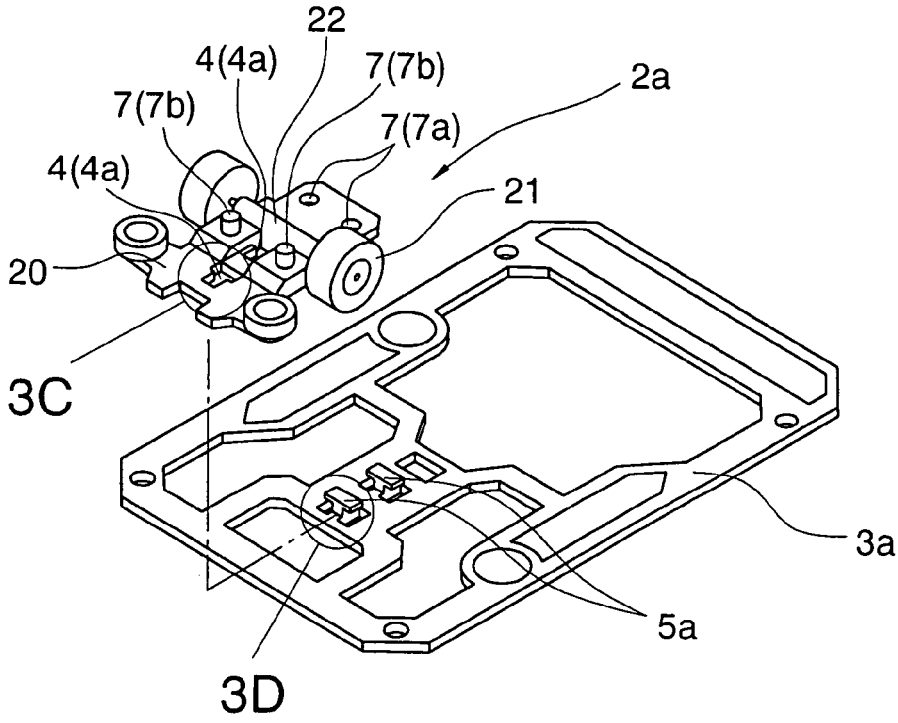
FIGS. 3A and 3B are perspective views showing a front wheel chassis and a lower frame member, and the front wheel chassis as supported by the lower frame member, respectively.
Figure 3B:
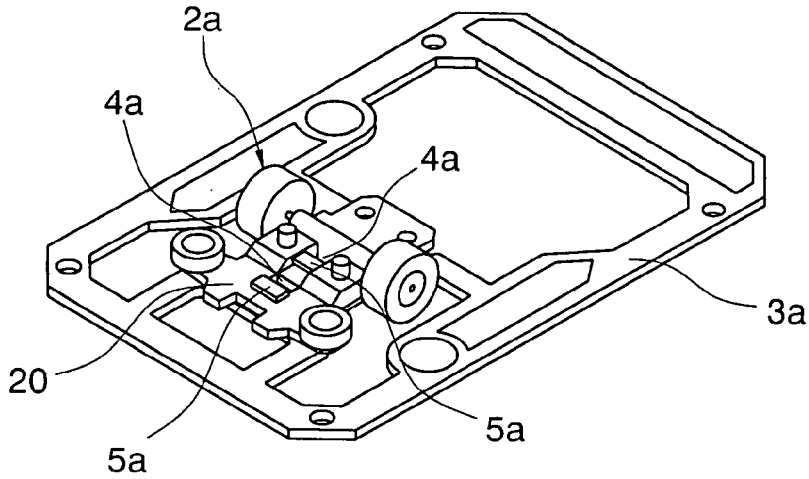
Figure 3C:
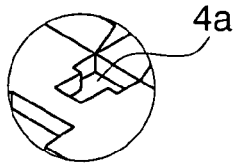
FIGS. 3C and 3D are enlarged views of encircled parts 3C and 3D in FIG. 3A, respectively.
Figure 3D:
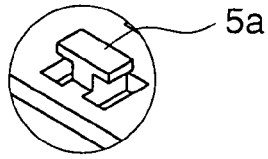

As shown in FIG. 3A, the front wheel chassis 2*a* includes a front chassis section 20 having an axle support 22 formed for supporting an axle of front wheels 21. The front chassis section 20 has a fitting portion 7 constituted by fitting holes 7*a* formed at the back of the axle support 22 so as to fittedly receive therein a fitting portion 7 constituted by fitting protrusions 7*e* formed at the bottom surface of a rear chassis section 30 of the rear wheel chassis 2*b*, which will be described later. The front chassis section 20 has another fitting portion 7 constituted by fitting protrusions 7*b* formed in front of the axle support 22 so as to fit into a fitting portion 7 constituted by cylindrical fitting parts 7*h* formed on the vehicle body 2*c*, which will be described later. The front chassis section 20 has the engaging portion 4 constituted by engaging parts 4*a* formed for engaging with the respective engaging elements 5*a* of the lower frame member 3*a*. As shown in FIG. 3C, each of the engaging parts 4*a* is composed of an opening formed in a T-shape as viewed from above that is narrow at its front and wide at its back. When the front wheel chassis 2*a* is slid backward while keeping each of the engaging elements 5*a* of the lower frame member 3*a* extruding from the wide part of the opening of a corresponding one of the engaging parts 4*a* of the front wheel chassis 2*a* and an overhang of the engaging part 5*a* is located to correspond to the narrow part of the opening, the front wheel chassis 2*a* can be held on the lower frame member 3*a*, as shown in FIG. 3B.

Figure 4A:
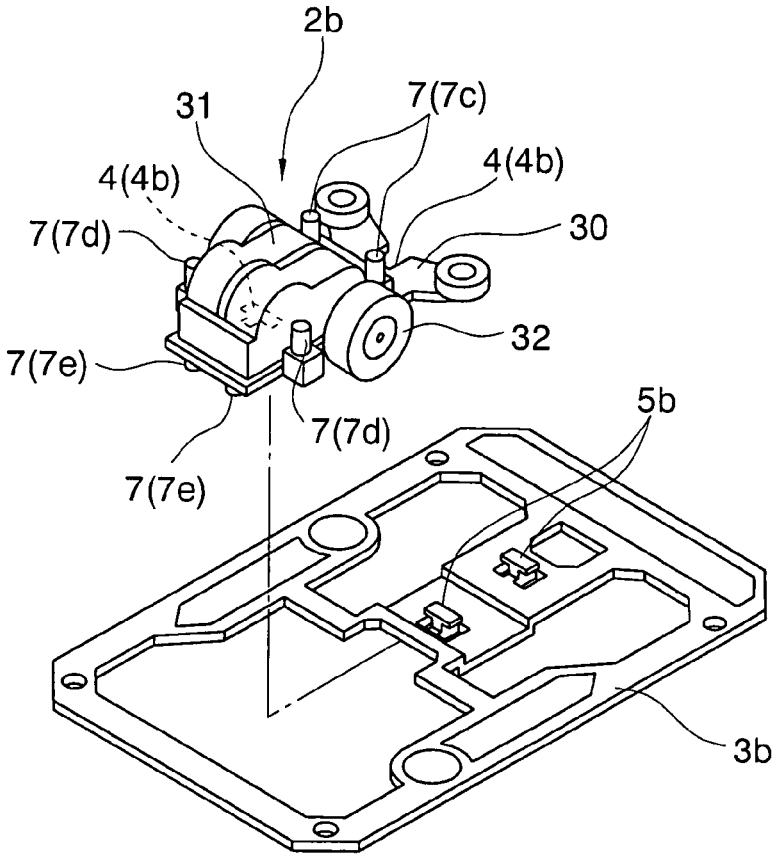
FIGS. 4A and 4B are perspective views showing a rear wheel chassis and a middle frame member, and the rear wheel chassis as supported by the middle frame member, respectively.
Figure 4B:
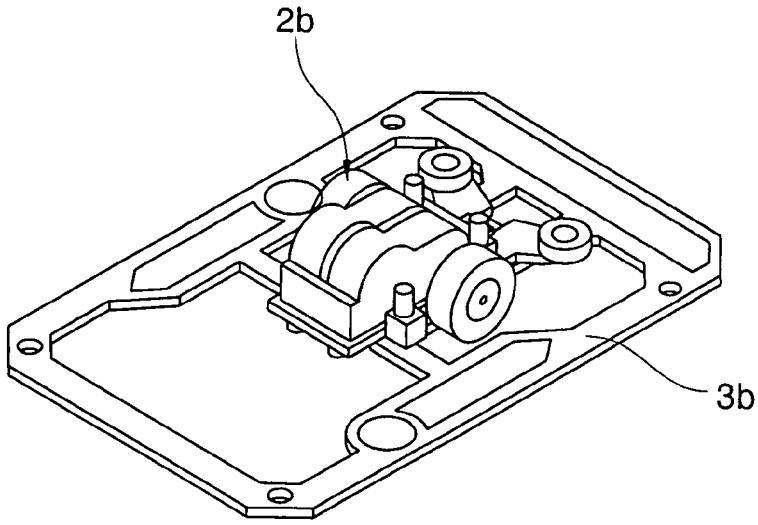

As shown in FIG. 4A, the rear wheel chassis 2*b* includes a rear chassis section 30 that has a spring unit 31 and driving wheels 32 driven by the spring unit 31 mounted thereon. The rear chassis section 30 has the engaging portion 4 including two engaging parts 4*b* which are formed at the back of the spring unit 31 and at the center of the bottom surface, respectively, so as to engage with the respective engaging elements 5*b* of the middle frame member 3*b*. When the rear wheel chassis 2*b* is slid backward while keeping the engaging parts 4*b* of the rear chassis section 30 corresponding to the respective engaging elements 5*b* of the middle frame member 3*b*, the rear wheel chassis 2*b* can be held on the middle frame member 3*b*, as shown in FIG. 4B. The spring unit 31 is known and uses a so-called pullback operation. That is, the driving wheels 32 are rotated in reverse as they contact a surface by moving the toy body backward. A spring installed inside the spring unit 31 is wound up and, by taking the hand off the body, an unwinding force of the spring causes the driving wheels 32 to rotate normally and the toy vehicle to move forward.

The rear chassis section 30 has a fitting portion 7 constituted by two pairs of fitting protrusions 7*c* and 7*d* formed at both sides of the spring unit 31 for fitting into a fitting portion 7 of the vehicle body 2*c* to be described later. The rear chassis section 30 also has another fitting portion 7 constituted by two fitting protrusions 7*e* formed at the front part of the bottom surface thereof for fitting into the respective fitting holes 7*a* formed on the front chassis section 20 of the front wheel chassis 2*a*.

Figure 5A:
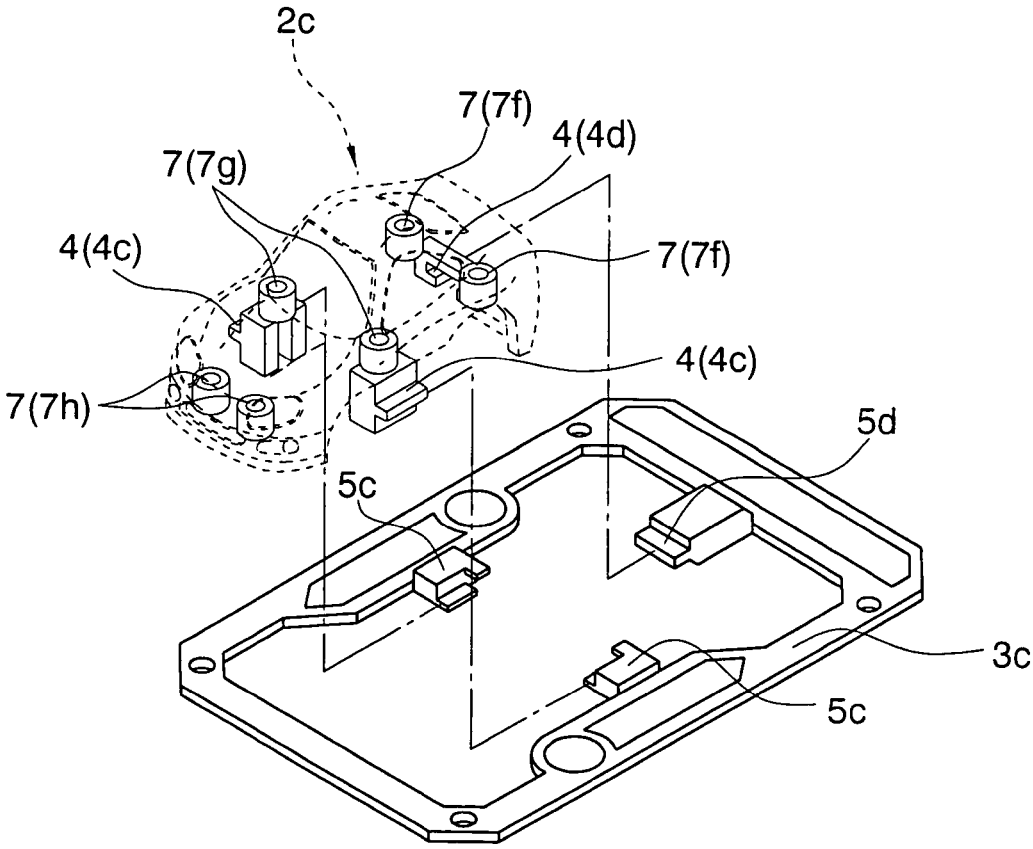
FIGS. 5A and 5B are perspective views showing a vehicle body and an upper frame member, and the vehicle body as supported by the upper frame member, respectively.
Figure 5B:
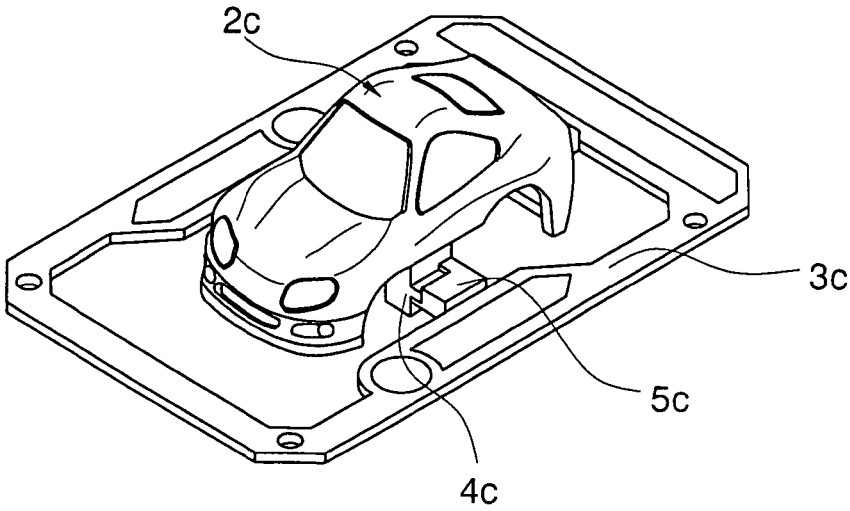

As shown in FIG. 5A, the vehicle body 2*c* has the engaging portion 4 constituted by two engaging parts 4*c* and an engaging part 4*d*, the former being formed at both sides of the vehicle body 2*c* for engaging with the engaging elements 5*c* of the upper frame member 3*c* and the latter being formed at the rear part of the vehicle body 2*c* for engaging with the engaging element 5*d* of the upper frame member 3*c*. When the vehicle body 2*c* is slid backward while keeping the engaging parts 4*c* corresponding to the engaging elements 5*c* and keeping the engaging part 4*d* corresponding to the engaging elements 5*d*, the vehicle body 2*c* can be held on the upper frame member 3*c*, as shown in FIG. 5B.

The vehicle body 2*c* has, at its both sides and its rear part, the fitting portion 7 constituted by two pairs of cylindrical fitting parts 7*f* and 7*g* formed integrally with the engaging parts 4*d* and 4*c* so as to fittedly receive therein the respective fitting protrusions 7*c* and 7*d* formed on the rear chassis section 30. The vehicle body 2*c* has the cylindrical fitting parts 7*h* formed at its front inside so as to fittedly receive therein the respective fitting protrusions 7*b* formed on the front chassis section 20.

Figure 6A:
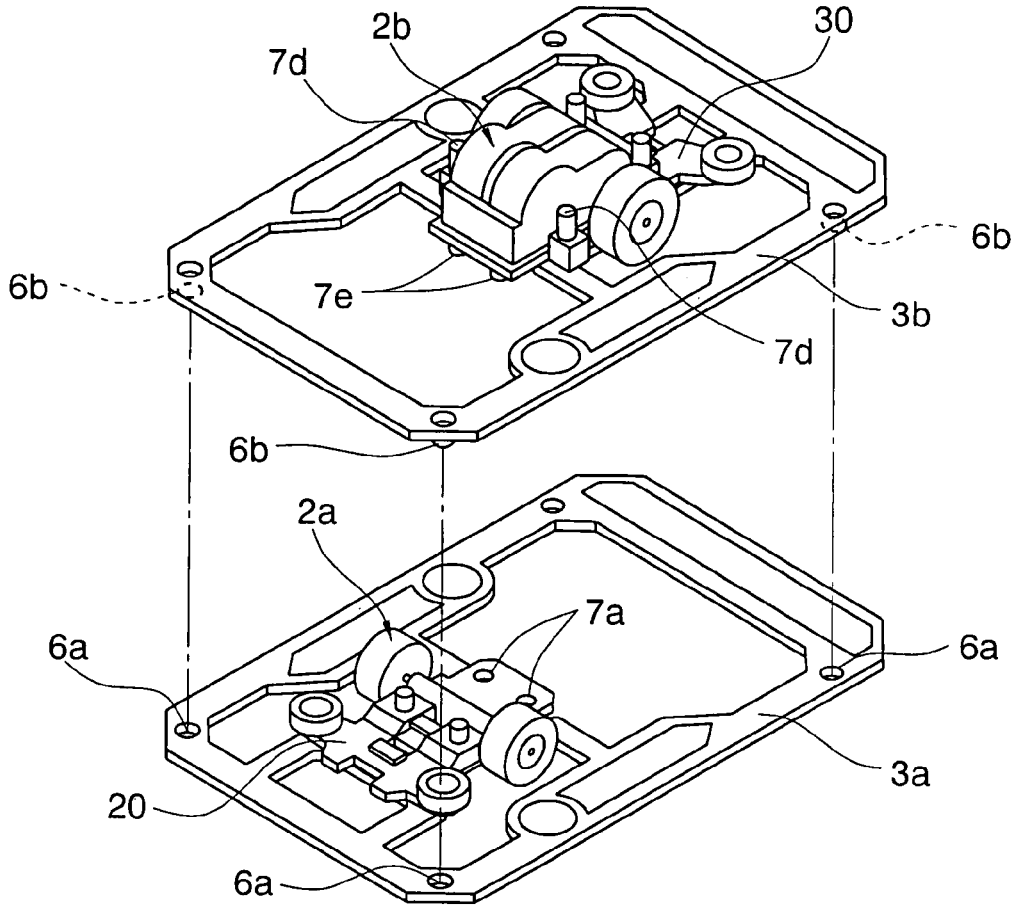
FIGS. 6A and 6B are perspective views of the front wheel chassis and the rear wheel chassis being connected to each other.
Figure 6B:
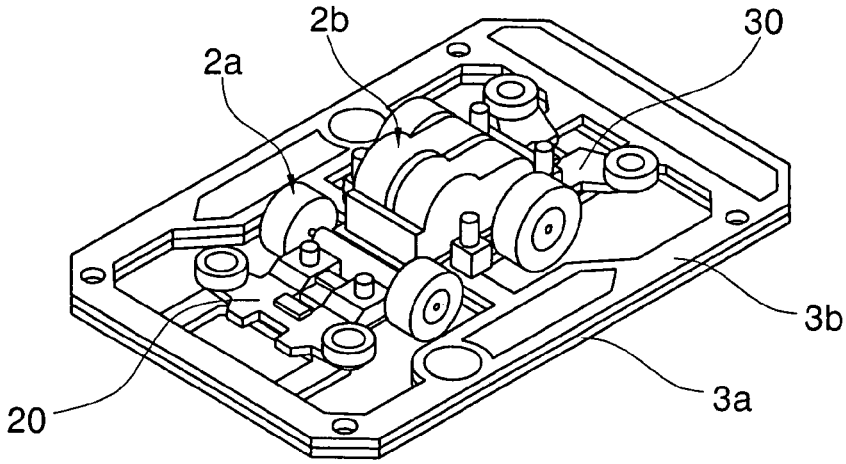

A description will now be made of the way by which the component members 2 (2*a* to 2*c*) are connected and assembled into the toy body or vehicle toy 1. Firstly, with the front wheel chassis 2*a* supported by the lower frame member 3*a* and the rear wheel chassis 2*b* supported by the middle frame member 3*b*, when the middle frame member 3*b* and the lower frame member 3*a* are stacked so that the fitting projections 6*b* of the middle frame member 3*b* can be fitted into the respective fitting recesses 6*a* of the lower frame member 3*a* as shown in FIG. 6A, the fitting protrusions 7*e* of the rear chassis section 30 are fitted into the respective fitting holes 7*a* of the front chassis section 20, whereby the front wheel chassis 2*a* and the rear wheel chassis 2*b* are connected one behind the other as shown in FIG. 6B.

Figure 7A:
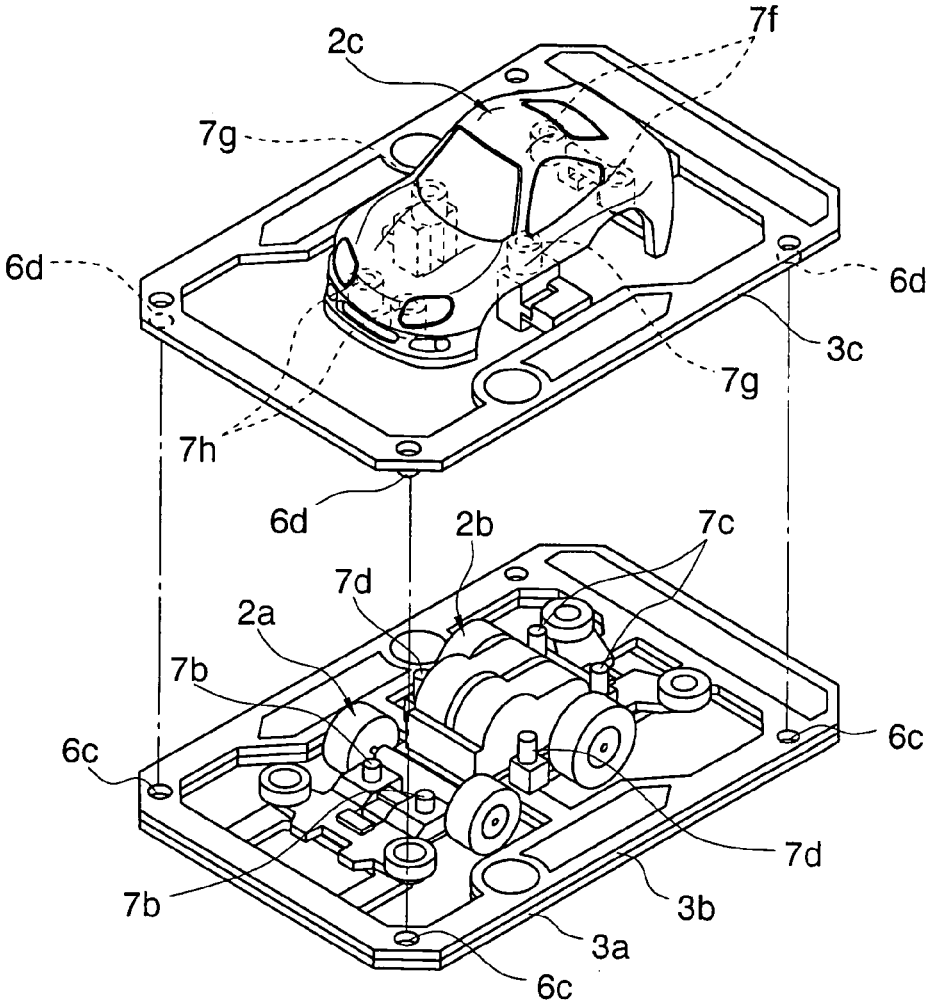
FIGS. 7A and 7B are perspective views of the vehicle body being connected to the front wheel chassis and rear wheel chassis which have been connected to each other.
Figure 7B:
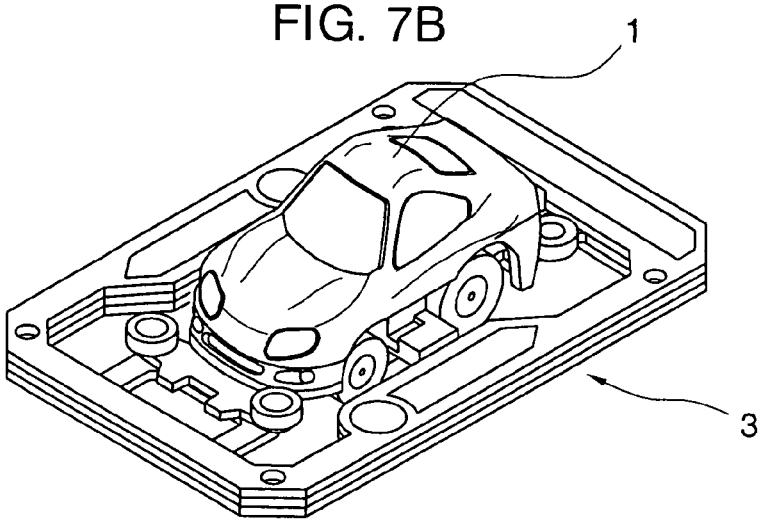

After the middle frame member 3*b* and the lower frame member 3*a* are stacked and connected one on top of the other, when the upper frame member 3*c* with the vehicle body 2*c* supported thereon is overlaid on the middle frame member 3*b* so that the fitting projections 6*d* of the upper frame member 3*c* can be fitted into the respective fitting recesses 6*c* of the middle frame member 3*b* as shown in FIG. 7A, the fitting protrusions 7*b* of the front chassis section 20 are fitted into the respective fitting parts 7*h* of the vehicle body 2*c*, and the fitting protrusions 7*c* and 7*d* of the rear chassis section 30 are fitted into the respective fitting parts 7*f* and 7*g* of the vehicle body 2*c*, whereby the vehicle body 2*c* is connected to the front wheel chassis 2*a* and the rear wheel chassis 2*b* to form the toy vehicle 1 as shown in FIG. 7B.

Figure 8A:
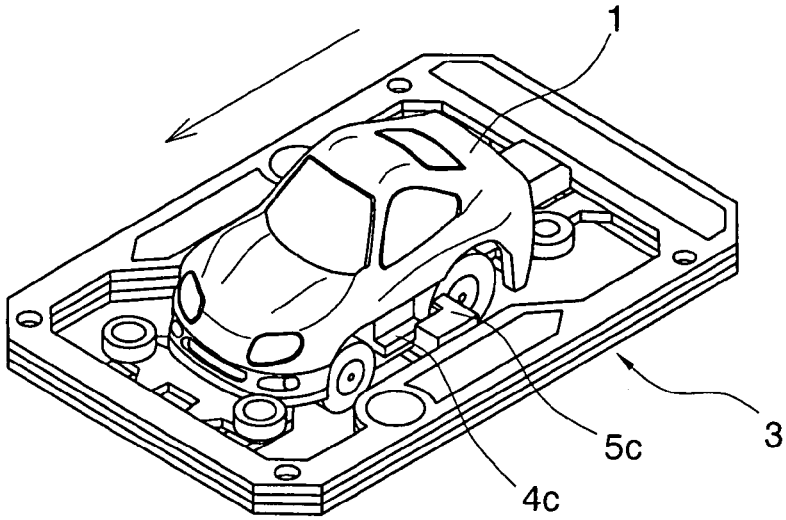
FIGS. 8A and 8B are perspective views of the toy body being separated from the support frame members.
Figure 8B:
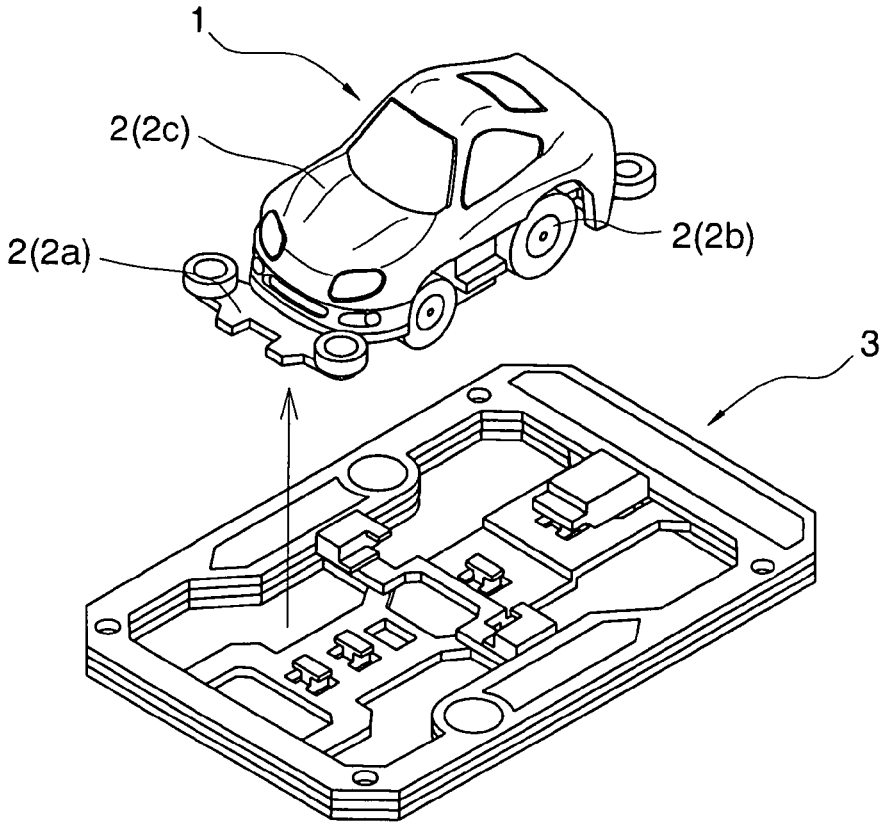

When all the component members 2 are connected and assembled into the toy vehicle 1 by connecting all the support frame members 3, and the toy vehicle 1 is pushed forward relative to the frame 3 as shown in FIG. 8A, all the component members 2 of the toy vehicle 1 are kept connected to one another but disengaged from the support frame members 3, which stay connected to one another, with the result that the toy vehicle 1 can be separated from the support frame members 3 as an integral toy, as shown in FIG. 8B.

Figure 9A:
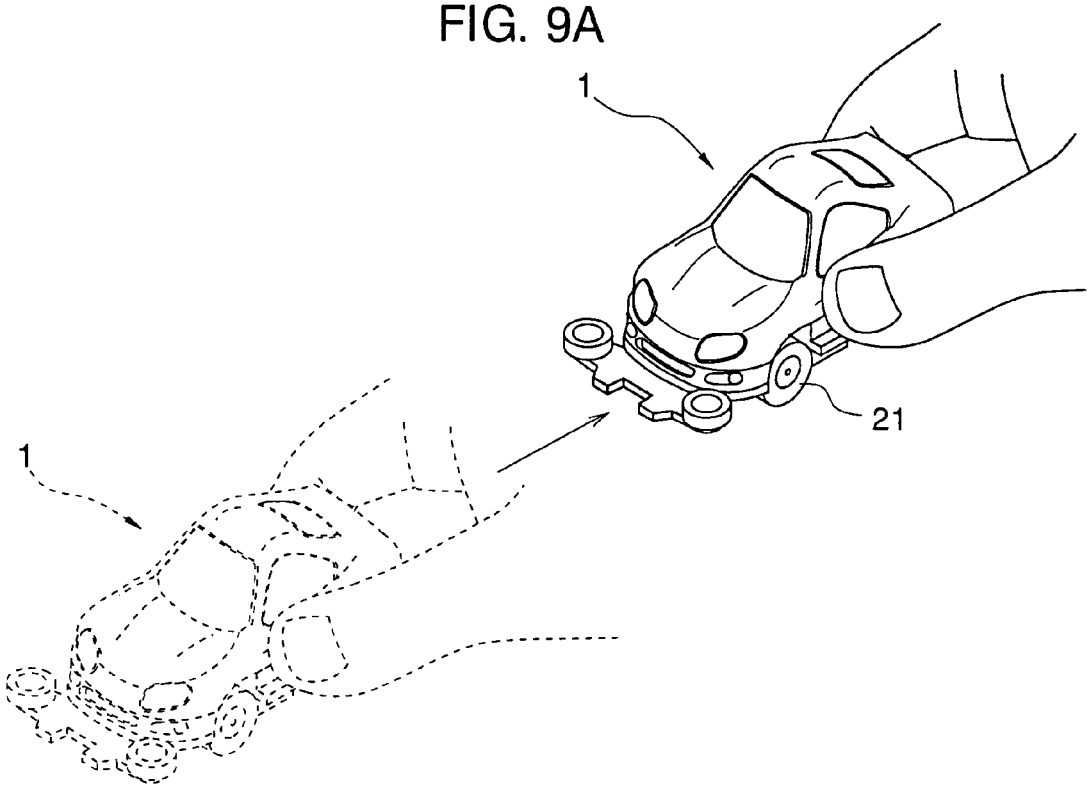
FIGS. 9A and 9B are perspective views of the toy body being used.
Figure 9B:
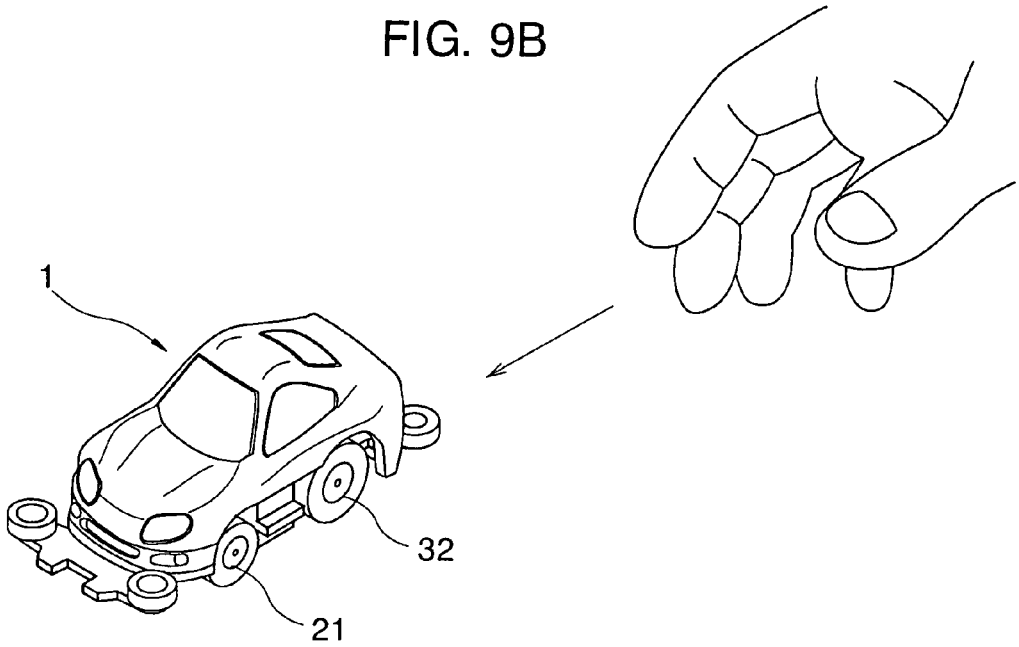

The thus separated toy vehicle 1 is moved backward while the wheels are kept in contact with a driving surface such as a floor as shown in FIG. 9A to thereby rotate the driving wheels 32 backward, so that the spring of the spring unit 31 is wound up. Subsequently, by letting go of the toy vehicle 1, the unwinding force of the spring can make the driving wheels 32 rotate forward as shown in FIG. 9B, thereby driving the toy vehicle 1 forward.

Figure 2:
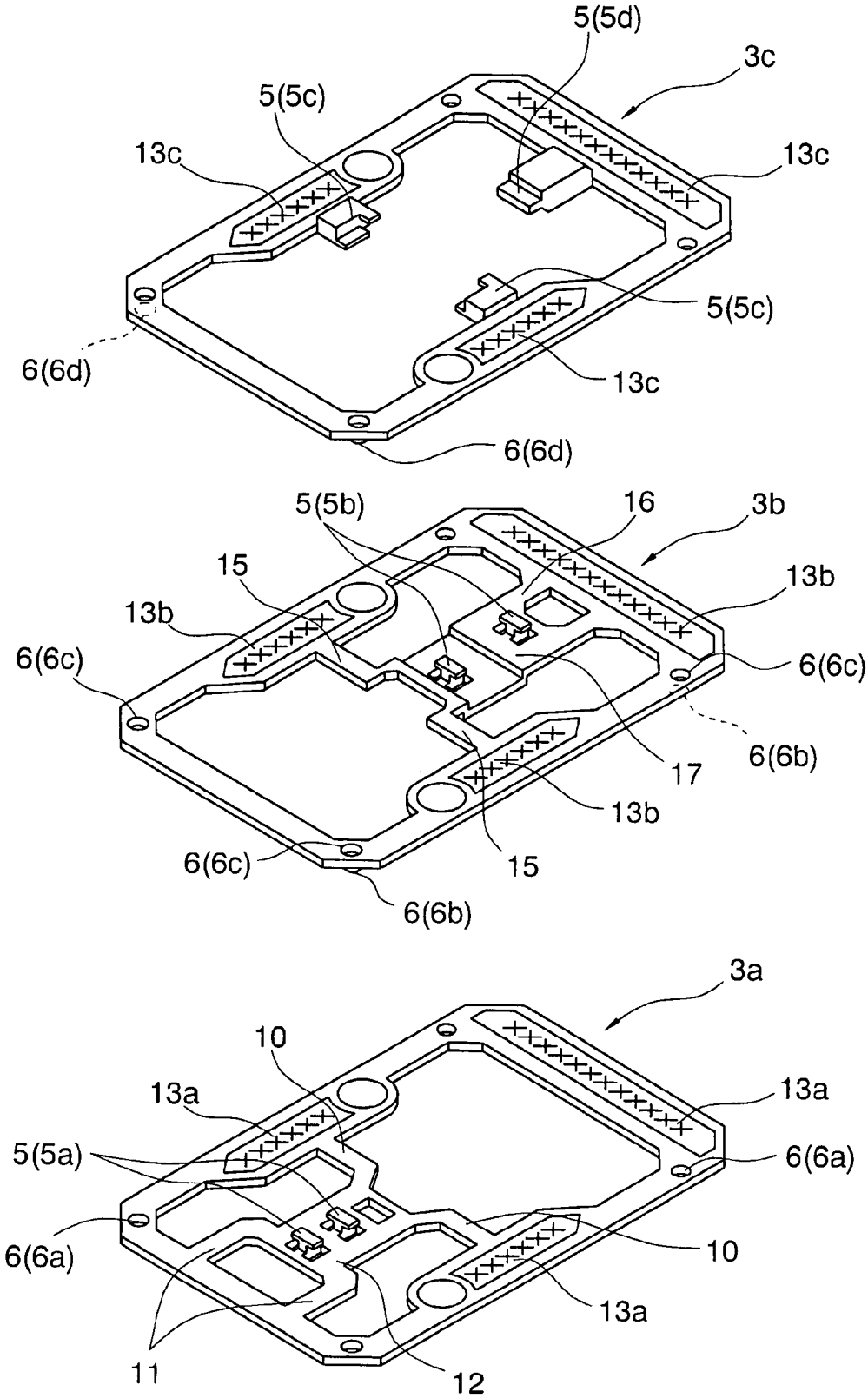
FIG. 2 is a perspective view showing structures of the support frame members.

The disassembly of the toy vehicle 1 is carried out in the following manner. The toy vehicle 1 is placed, in a forward position, on the support frame members 3 connected to one another as shown in FIG. 8A and the toy vehicle 1 is slid backward so that the toy vehicle 1 goes back to the state in which the toy vehicle 1 is supported by the support frame members 3 as shown in FIG. 7B. Subsequently, the support frame members 3 are disconnected from one another. As a result, the component members 2 making up the toy vehicle 1 can be disconnected from one another, enabling the front wheel chassis 2*a* to be supported by the lower frame member 3*a* (see FIG. 2B), the rear wheel chassis 2*b* to be supported by the middle frame member 3*b* (see FIG. 3B), and the vehicle body 2*c* to be supported by the upper frame member 3*c* (see FIG. 4B). Namely, by disconnecting the support frame members 3 from one another, the toy vehicle 1 can be separated into the component members 2.

When the component members 2 are stored as supported by the respective support frame members 3, it is unlikely that the component members will be mixed in a disorderly manner, which makes it easy to find a desired component member. In the case where the support frame member 3 has a sticker or stickers 13*a* or other indicia thereon providing information on the component members 2, by making different combinations of the component members 2 while confirming such information and connecting the support frame members 3, the driving performance can be changed by selecting a spring unit from spring units of different driving characteristics and combining it with other component members 2 as desired or a running toy or toy vehicle of originality can be assembled by combining a special vehicle body with other component members according to one's taste.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A toy assembly device, comprising:

a toy body including a plurality of component members; and a plurality of support frame members for supporting the respective component members; wherein each of the component members and a corresponding one of the support frame members have respective engaging portions, and the engaging portion of said each of the component members and the engaging portion of said corresponding one of the support frame members can engage with each other in a first direction and disengage in a direction opposite the first direction;

the support frame members have fitting parts and can be connected in a second, different direction by the fitting parts and disconnected in a direction opposite the second direction;

the component members have fitting portions and are connected directly to one another in the second direction by the fitting portions and disconnected in a direction opposite the second direction;

when the support frame members are connected to one another by the fitting parts, while the component members are supported by the respective support frame members, the component members are connected with one another by the fitting portions to form the toy body in an assembled state;

the assembled toy body can be engaged with, in the first direction, the support frame members connected to one another, and disengaged from, in the direction opposite the first direction, the support frame members connected to one another; and when the connection of the support frame members is released in the direction opposite the second direction, while the toy body is supported by the support frame members, the toy body is disassembled into the component members that are separately supported by the respective support frame members.

2. The device of claim 1, wherein the toy body is a toy vehicle and the component members are a front wheel chassis, a rear wheel chassis, and a vehicle body;

the front wheel chassis and the rear wheel chassis each has a respective one of the fitting portions, to thereby connect the front wheel chassis and the rear wheel chassis with each other; and the vehicle body has at least one of the fitting portions, and the front wheel chassis and the rear wheel chassis each has a respective at least one of the fitting portions, whereby the vehicle body is connected with the front wheel chassis and the rear wheel chassis.

3. The device of claim 1, wherein each of the support frame members has indicia providing information on a corresponding one of the component members to be supported thereon.

4. A toy assembly device, comprising:

a toy body including a plurality of component members; and a plurality of support frame members, each having a substantially rectangular shape for supporting the respective component members and substantially flat first and second surfaces; wherein each of the component members and a corresponding one of the support frame members have respective engaging portions to hold the component member in place, and the engaging portion of said each of the component members and the engaging portion of said corresponding one of the component members can engage with each other in a first direction parallel to the first surface of the support frame member and disengage in a direction opposite the first direction;

each of the support frame members has a fitting part on at least one of the first and second surfaces thereof so that the support frame members can be detachably connected to one another by the fitting parts when the support frame members are stacked on one another;

each of the component members has a fitting portion so that the component members can be detachably connected directly to one another in a second direction perpendicular to the first direction by the fitting portions;

when the support frame members with the respective component members supported thereon are stacked on one another, the component members are connected with one another by the fitting portions to form the toy body in an assembled state;

the assembled toy body can be engaged with, in the first direction, the support frame members connected to one another, and disengaged from, in a direction opposite the first direction, the support frame members connected to one another; and when the support frame members are disconnected in a direction opposite the second direction, while the toy body is supported by the support frame members, the toy body is disassembled into the component members that are supported by the respective support frame members.

5. The device of claim 4, wherein the toy body is a toy vehicle and the component members are a front wheel chassis, a rear wheel chassis, and a vehicle body;

the front wheel chassis and the rear wheel chassis each has a respective one of the fitting portions, to thereby connect the front wheel chassis and the rear wheel chassis with each other; and the vehicle body has at least one of the fitting portions, and the front wheel chassis and the rear wheel chassis each has a respective at least one of the fitting portions, whereby the vehicle body is connected with the front wheel chassis and the rear wheel chassis.

6. The device of claim 4, wherein each of the support frame members has indicia providing information on a corresponding one of the component members to be supported thereon.

7. A toy vehicle comprising:

a toy body including a front wheel chassis, a rear wheel chassis, and a vehicle body;

a first support frame member for supporting the front wheel chassis;

a second support frame member for supporting the rear wheel chassis;

a third support frame member for supporting the vehicle body, the first, second and third support frame members having substantially the same shape and substantially flat first and second opposing surfaces; wherein the front wheel chassis and the first support frame member have respective first engaging portions to detachably hold the front wheel chassis in place, the first engaging portions engaging with each other in a first direction parallel to the first surface of the first support frame member, and disengaging in a direction opposite the first direction;

the rear wheel chassis and the second support frame member have respective second engaging portions to detachably hold the rear wheel chassis in place, the second engaging portions engaging with each other in the first direction, and disengaging in a direction opposite the first direction;

the vehicle body and the third support frame member have respective third engaging portions to detachably hold the vehicle body in place, the third engaging portions engaging with each other in the first direction, and disengaging in a direction opposite the first direction;

each of the front wheel chassis, the rear wheel chassis and the vehicle body has a fitting portion so that the front wheel chassis, the rear wheel chassis and the vehicle body can be detachably connected directly to one another in a second direction perpendicular to the first direction by the fitting portions, and disconnected in a direction opposite to the second direction;

when the first, second and third support frame members supporting the front wheel chassis, the rear wheel chassis and the vehicle body, respectively, are stacked on one another, the front wheel chassis, the rear wheel chassis and the vehicle body are connected to one another by the fitting portions to form the toy body in an assembled state; and the assembled toy body can be engaged with the first, second and third support frame members connected to one another in the first direction, and disengaged in the direction opposite the first direction.

8. The toy vehicle of claim 7, wherein when the first, second and third support frame members connected to one another are disconnected, while the toy body is supported by the first, second and third support frame members, the toy body is disassembled into the front wheel chassis, the rear wheel chassis and the vehicle body which are supported by the first, second and third support frame members, respectively.

9. The toy vehicle of claim 8, wherein the first, second and third support frame members have respective indicia providing information on the front wheel chassis, the rear wheel chassis and the vehicle body to be supported thereon.

10. A method for assembling a toy comprising:

forming a toy body to include a plurality of component members; and forming a plurality of support frame members for supporting the respective component members;

providing each of the component members and a corresponding one of the support frame members with respective engaging portions, and detachably engaging the engaging portion of said each of the component members and the engaging portion of said corresponding one of the support frame members along a first axial direction;

providing the support frame members with fitting parts and detachably connecting the support frame members along a second, different axial direction by the fitting parts; and providing the component members with fitting portions and detachably connecting the component members directly to one another along the second axial direction by the fitting portions;

wherein, when the support frame members are connected to one another by the fitting parts while the component members are supported by the respective support frame members, connecting the component members with one another by the fitting portions to form the toy body in an assembled state.

11. The method of claim 10, further comprising disengaging the assembled toy body, along the first axial direction, from the support frame members connected to one another.

12. The method of claim 11, further comprising engaging the assembled toy body, in the first direction, with the support frame members connected to one another.

13. The method of claim, 10, further comprising:

releasing the connection of the support frame members while the toy body is supported by the support frame members, and disassembling the toy body into the component members that are separately supported by the respective support frame members.

14. The method of claim 10, further comprising:

forming the toy body as a toy vehicle and the component members as a front wheel chassis, a rear wheel chassis, and a vehicle body;

forming each of the front wheel chassis and the rear wheel chassis to include a respective one of the fitting portions, to allow connection of the front wheel chassis and the rear wheel chassis with each other; and forming the vehicle body to include at least one of the fitting portions, and the front wheel chassis and the rear wheel chassis to include a respective at least one of the fitting portions, whereby the vehicle body is connected with the front wheel chassis and the rear wheel chassis.

15. The method of claim 10, further comprising:

forming at least one of the support frame members to include indicia providing information on one of the component members to be supported thereon.

* * * * *